US009658632B2

(12) United States Patent
Wright

(10) Patent No.: US 9,658,632 B2
(45) Date of Patent: May 23, 2017

(54) SYSTEMS, METHODS, AND DEVICES FOR BOOTSTRAPPED POWER CIRCUITS

(71) Applicant: Cypress Semiconductor Corporation, San Jose, CA (US)

(72) Inventor: David G. Wright, Woodinville, WA (US)

(73) Assignee: Cypress Semiconductor Corporation, San Jose, CA (US)

( * ) Notice: Subject to any disclaimer, the term of this patent is extended or adjusted under 35 U.S.C. 154(b) by 0 days.

(21) Appl. No.: 14/668,670

(22) Filed: Mar. 25, 2015

(65) Prior Publication Data

US 2016/0062379 A1 Mar. 3, 2016

Related U.S. Application Data

(60) Provisional application No. 62/042,589, filed on Aug. 27, 2014.

(51) Int. Cl.
*G05F 1/625* (2006.01)

(52) U.S. Cl.
CPC ..... *G05F 1/625* (2013.01)

(58) Field of Classification Search
CPC ..... G05F 1/625; G05B 15/02
USPC ..... 700/292
See application file for complete search history.

(56) References Cited

U.S. PATENT DOCUMENTS 4,878,010 A * 10/1989 Weber ..... H02M 5/257 323/300
5,182,810 A 1/1993 Bartling et al.
5,459,652 A 10/1995 Faulk
5,627,460 A 5/1997 Bazinet et al.
6,188,274 B1 * 2/2001 Vernon ..... H02J 7/345 327/536
6,370,046 B1 * 4/2002 Nebrigic ..... H02M 3/07 327/536
6,714,067 B1 3/2004 Farrenkopf
(Continued)

FOREIGN PATENT DOCUMENTS

WO 2010095112 A1 8/2010

OTHER PUBLICATIONS

"Measuring the Sine Wave", Oct. 29, 2011, Learn about electronics, pp. 1-4.*

(Continued)

*Primary Examiner* — Kenneth M Lo
*Assistant Examiner* — Alan Chu

(57) ABSTRACT

Systems, methods, and devices are disclosed for implementing a bootstrapped power circuit. Devices may include a controller configured to generate an output signal. Devices may include a power converter configured to receive the output signal, configured to store an amount of energy in response to receiving the output signal, and further configured to release the amount of energy in response to detecting a change in the output signal. Devices may include a switch configured to be toggled between a first and second position. Devices may include a power source configured to store a second voltage having a second amplitude. Devices may include a bootstrap circuit configured to receive a third voltage from the power source when the switch is in the first position, and configured to receive at least some of the amount of energy from the power converter when the switch is in the second position.

18 Claims, 7 Drawing Sheets

(56) References Cited

U.S. PATENT DOCUMENTS

| | | | | |
|---|---|---|---|---|
| 6,868,500 | B1 | 3/2005 | Kutz et al. | |
| 8,212,493 | B2 | 7/2012 | Melanson et al. | |
| 2011/0234123 | A1* | 9/2011 | Myers | H05B 33/0815 315/307 |
| 2012/0257425 | A1* | 10/2012 | Satou | H02M 1/08 363/37 |
| 2012/0262144 | A1* | 10/2012 | Lyons | H05B 33/0815 323/311 |
| 2013/0151825 | A1* | 6/2013 | Huynh | H02M 1/08 713/1 |
| 2014/0097786 | A1 | 4/2014 | Grimes et al. | |
| 2014/0103840 | A1* | 4/2014 | Lim | H02P 6/14 318/139 |
| 2014/0117961 | A1* | 5/2014 | Rigoni | H02M 3/156 323/282 |
| 2015/0061611 | A1* | 3/2015 | Li | H02M 3/1588 323/235 |

OTHER PUBLICATIONS

"An MCU-based low cost non-inverting buck-boost converter for battery chargers", STMicroelectronics, AN2389 Application note, Aug. 2007, 16 pgs.
"Compiled Tips 'N Tricks Guide", Microchip Technology, 2009, 13 pgs.

* cited by examiner

SYSTEMS, METHODS, AND DEVICES FOR BOOTSTRAPPED POWER CIRCUITS

CROSS-REFERENCE TO RELATED APPLICATIONS

This application claims the benefit under 35 U.S.C. §119 (e) of U.S. Provisional Patent Application No. 62/042,589, filed on Aug. 27, 2014, which is incorporated by reference herein in its entirety for all purposes.

TECHNICAL FIELD

This disclosure generally relates to power circuits and, more specifically, to power circuits associated with consumer electronic devices.

BACKGROUND

Consumer electronic devices may be used for various different applications in various different contexts. For example, consumer electronic devices may be shavers, toothbrushes, toys, wireless keyboards, wireless remotes, and wireless computer mice. Such consumer electronic devices may be low power electronic devices that operate using voltage or power sources having a relatively small amplitude. For example, such consumer electronic devices may be powered by battery cells, such as AA and AAA batteries. Various conventional devices may utilize two or more battery cells because the voltage provided by a single battery cell may not be sufficient to power various internal electrical components of the electronic devices. Accordingly, conventional consumer electronics remain limited in their ability to efficiently and economically operate using a single battery cell.

SUMMARY

Disclosed herein are systems, methods, and devices for implementing bootstrapped power circuits. In some embodiments, devices as disclosed herein may include a controller configured to generate an output signal based on a detected input voltage, where the controller is further configured to begin operation in response to receiving a first voltage having a first amplitude. The devices may also include a power converter coupled to the controller and configured to receive the output signal, where the power converter is further configured to store an amount of energy in response to receiving the output signal, and where the power converter is further configured to release at least part of the amount of energy in response to detecting a change in the output signal. The devices may further include a switch configured to be set to one of a plurality of positions, where the plurality of positions includes a first position and a second position. The devices may also include a power source coupled to the power converter and the switch, where the power source is configured to supply a second voltage having a second amplitude. The devices may further include a bootstrap circuit configured to receive a third voltage from the power source when the switch is in the first position, where a combined amplitude of the second voltage and the third voltage is greater than the first amplitude, and where the bootstrap circuit is further configured to receive at least some of the amount of energy from the power converter when the switch is in the second position.

In some embodiments, the bootstrap circuit includes at least one capacitor having a capacitance configured to store the third voltage. In various embodiments, a combination of the second voltage and the third voltage is sufficient to enable the operation of the controller. According to some embodiments, the switch is a mechanical switch. Furthermore, the switch may be configured to change between the first position and the second position in response to actuation by a user. In some embodiments, the power converter is an inductor-based power converter. Furthermore, the power converter may include a transistor, and the output signal may be received at the transistor. In various embodiments, the output signal is a pulse, and the change detected by the power converter is a termination of the pulse. In some embodiments, the controller is a microcontroller unit (MCU), where the MCU includes a processor core and a memory. According to various embodiments, the controller may be configured to generate a power supply signal for at least one electrical component of a battery-powered electrical device.

Also disclosed herein are systems that may include a bootstrapped power circuit that includes a controller configured to generate an output signal based on a detected input voltage, where the controller is further configured to begin operation in response to receiving a first voltage having a first amplitude. The bootstrapped power circuit may also include a power converter coupled to the controller and configured to receive the output signal, where the power converter is further configured to store an amount of energy in response to receiving the output signal, and where the power converter is further configured to release at least part of the amount of energy in response to detecting a change in the output signal. The bootstrapped power circuit may also include a first switch configured to be set to one of a first plurality of positions, where the first plurality of positions includes a first position and a second position. The bootstrapped power circuit may further include a power source coupled to the power converter and the first switch, where the power source is configured to supply a second voltage having a second amplitude. In various embodiments, the bootstrapped power circuit may include a bootstrap circuit configured to receive a third voltage from the power source when the first switch is in the first position, where a combined amplitude of the second voltage and the third voltage is greater than the first amplitude, and where the bootstrap circuit is further configured to receive at least some of the amount of energy from the power converter when the first switch is in the second position. The systems may also include a load circuit coupled to the bootstrapped power circuit and configured to receive a voltage supply signal from the controller.

In various embodiments, the bootstrap circuit includes a capacitor having a capacitance configured to store the third voltage, and the first switch is a mechanical switch. In some embodiments, a combination of the second voltage and the third voltage is sufficient to enable the operation of the controller. According to various embodiments, the systems may also include a second switch configured to be set to one of a second plurality of positions, where the second plurality of positions includes a third position and a fourth position, where the second switch is configured to uncouple the bootstrapped power circuit from the load circuit when in the third position, and where the second switch is configured to couple the bootstrapped power circuit with the load circuit when in the fourth position. In some embodiments, the load circuit includes a motor configured to generate mechanical motion in response to receiving the voltage supply signal. According to various embodiments, the load circuit includes a light emitting diode (LED).

Also disclosed herein are methods that may include coupling, by switching a switch to a first position, a bootstrap circuit to a power source in parallel to store a first voltage in the bootstrap circuit, where the power source stores a second voltage. The methods may also include coupling, by switching the switch to a second position, the bootstrap circuit to a controller and the power source in series to provide the first voltage and the second voltage to the controller. The methods may further include powering up the controller in response to receiving the first voltage and the second voltage, a combination of the first voltage and the second voltage being greater than an operational voltage associated with the controller.

In various embodiments, the methods may further include generating, using the controller, an output signal in response to identifying a low voltage at an input of the controller, and providing the output signal to a power converter. The methods may also include storing, in the power converter, an amount of energy in response to receiving the output signal. According to various embodiments, the methods may also include detecting, by the power converter, a termination of the output signal, and providing at least part of the amount of energy to the bootstrap circuit in response to the detecting of the termination of the output signal.

DETAILED DESCRIPTION

In the following description, numerous specific details are set forth in order to provide a thorough understanding of the presented concepts. The presented concepts may be practiced without some or all of these specific details. In other instances, well known process operations have not been described in detail so as to not unnecessarily obscure the described concepts. While some concepts will be described in conjunction with the specific examples, it will be understood that these examples are not intended to be limiting.

As discussed above, consumer electronic devices, such as toothbrushes and shavers, may have an operating voltage of at least about 1.8V. Battery cells may have an initial voltage of about 1.5V which may, when used alone, be insufficient to drive such electronic devices. Moreover, the voltage of the battery cell may further decay to about 0.9V over time. Accordingly, conventional devices often utilize multiple battery cells to maintain a sufficient operating voltage. However, the inclusion of additional battery cells results in enclosure designs having a much larger size which may not be suitable for the particular application of the electronic device. Some other conventional devices incorporate discrete boost converters that may be implemented with a single battery cell. However, such discrete boost converters are relatively expensive due to the additional circuitry required. Moreover, such conventional devices often are still unable to generate a sufficient voltage to start the device, and a controller included in the device, without further costly circuitry.

Various bootstrapped power systems, devices, and methods are disclosed herein enable the efficient and economic commencement of operation of consumer electronic devices that may be low power electronic devices and may be powered by a single battery cell. As disclosed herein, a bootstrapped power circuit may include a bootstrap circuit that may be coupled to a power supply, such as a battery cell, to receive an initial amount of charge. That charge in conjunction with the battery cell may be coupled to a controller that may be used to generate a power supply signal for the electronic device and control the operation of one or more components of the electronic device. Once the controller receives the combined voltage of the bootstrap circuit and the power supply, the controller may start up and commence operation. Moreover, the controller may be configured to manage and control the operation of a power converter to ensure that the operational voltage of the electronic device stays within tolerance or a particular operational range. In this way, the bootstrap circuit may enable the controller to commence operation, and once operational, the controller may operate as its own boost converter.

Figure 1:
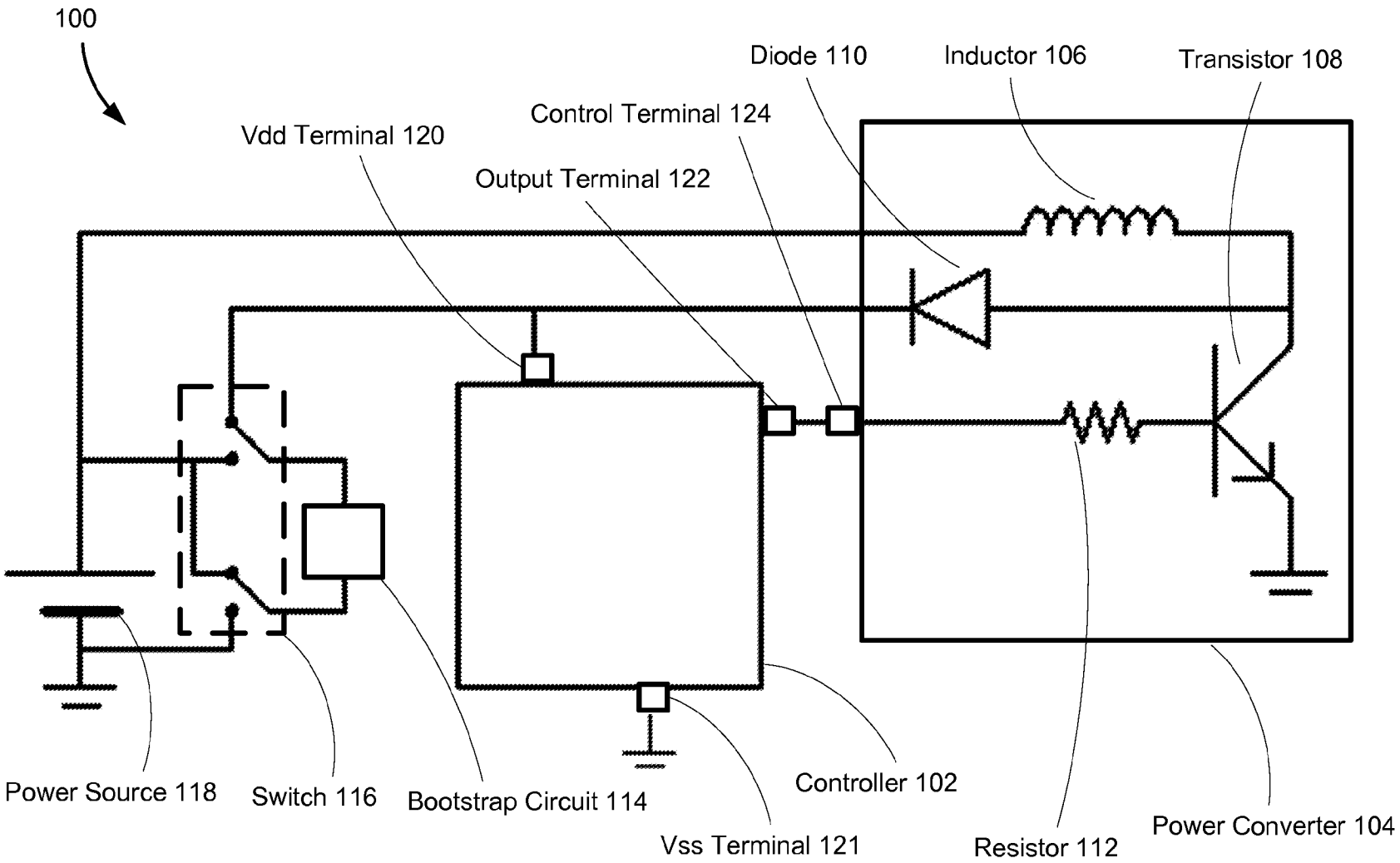
FIG. 1 illustrates a diagram of an example of a bootstrapped power circuit, implemented in accordance with some embodiments.

FIG. 1 illustrates a diagram of an example of a bootstrapped power circuit, implemented in accordance with some embodiments. As similarly discussed above, power circuits used in consumer electronic devices may implement various components, such as a power converter, to boost a voltage provided by a power source, such as a battery, that may be included in the electronic device. However, the power converter and an associated controller may require an initial amount of energy to begin operation when the device is turned on. Accordingly, a bootstrapped power circuit, such as bootstrapped power circuit 100, may be implemented that includes a bootstrap circuit configured to provide an initial amount of energy sufficient to enable commencement of operation of the controller and the power converter included in the electronic device.

In various embodiments, bootstrapped power circuit 100 may include a controller, such as controller 102. In some embodiments, controller 102 may be a microcontroller unit (MCU) that may include a processor core and a memory. For example, controller 102 may be a PSoC mixed signal device manufactured by Cypress Semiconductor and may be configured to control the operation of one or more electrical components of bootstrapped power circuit 100 and an electrical device that may include bootstrapped power circuit 100. Controller 102 may be further configured to control the operation of one or more components of a power converter, such as power converter 104 discussed in greater detail below, to regulate an operational voltage associated with the electrical device that includes bootstrapped power circuit 100, and ensure that the operational voltage is maintained within a particular voltage range. For example, as will be discussed in greater detail below, the operational voltage may be kept within a range of about 2V to 4V.

In various embodiments, switch 116 may initially be in an off position or state such that controller 102 is not powered and is not operational, as may be the case when the associated electrical device is not in use. As similarly discussed above, controller 102 may utilize an initial amount of charge or voltage to commence operation. For example, controller 102 may commence operation in response to receiving a voltage of about 1.8V to 2V, or greater, at an input terminal or pin, such as Vdd terminal 120. Such a voltage may be provided for a particular duration of time, which in one example may between about 1 millisecond to 3 milliseconds. Once controller 102 is able to draw initial power from the bootstrap circuit 114, controller 102 may commence operation and maintain an operational voltage of bootstrapped power circuit 100. In some embodiments, controller 102 may also include Vss terminal 121 which may be coupled to a circuit ground.

In various embodiments, bootstrapped power circuit 100 may further include power converter 104 which may be configured to operate in conjunction with other components of bootstrapped power circuit 100 to supplement or augment a voltage from power source 118, to supply controller 102, and boost the output voltage of bootstrapped power circuit 100 to within an operational range. In various embodiments, power converter 104 may be coupled to power source 118, bootstrap circuit 114, and controller 102. Power converter 104 may include an energy storage element which may periodically store an amount of energy and may periodically release the stored energy into bootstrapped power circuit 100 to supplement or augment the voltage at the input pin or port of controller 102. As will be discussed in greater detail below, controller 102 may be configured to control the operation of one or more components of power converter 104, and may be further configured to manage the charging and discharge of the energy storage element.

In some embodiments, the energy storage element included in power converter 104 may be an inductor, such as inductor 106. Accordingly, inductor 106 may have a first terminal coupled to power source 118. Inductor 106 may have a second terminal coupled to transistor 108 and diode 110. Inductor 106 may be configured to store energy when current is passed through it, as may be the case when transistor 108 is turned on, and inductor 106 may be further configured to release the energy when transistor 108 is turned off, and the current passed through inductor 106 is reduced. In this way, inductor 106 may periodically store and release energy to affect other components of bootstrapped power circuit 100, and supplement or augment the voltage at the input pin or port of controller 102. As will be discussed in greater detail below, the passage of current through inductor 106 may be controlled, at least in part, by a state of transistor 108 and the operation of controller 102. In some embodiments, inductor 106 may have an inductance of about 100 microhenrys.

As discussed above, according to various embodiments, power converter 104 may further include transistor 108 which may be configured to be switched on and off by controller 102 using a control pin such as output terminal 122 which may be coupled to a control terminal of power converter 104, such as control terminal 124. Transistor 108 may have a first terminal coupled to inductor 106, a second terminal coupled to a circuit ground, and a third terminal coupled to controller 102. In various embodiments, transistor 108 may be any suitable transistor, such as a bipolar junction transistor (BJT) or a field-effect transistor (FET). The switching of transistor 108 may be controlled by a voltage applied to a base or a gate terminal of transistor 108. For example, when the voltage applied to a base terminal of transistor 108 is high, transistor 108 may be switched on, and a terminal of inductor 106 may be coupled with a circuit ground. When the voltage applied to the base terminal of transistor 108 is low, transistor 108 may be switched off, and transistor 108 may effectively be an open circuit relative to inductor 106. According to some embodiments, transistor 108 may be coupled to controller 102 via a resistor, such as resistor 112 or directly from output terminal 122.

Power converter 104 may further include diode 110 which may be configured to control the flow of current from inductor 106 to bootstrap circuit 114. In various embodiments, diode 110 may be configured to conduct current in a particular direction in response to a particular set of voltage conditions. For example, when a voltage on a first terminal of diode 110 that may be coupled to inductor 106 is higher than a voltage on a second terminal of diode 110 coupled to bootstrap circuit 114, diode 110 may conduct current in a direction from inductor 106 to bootstrap circuit 114. When these voltage conditions are not met, such as a voltage on the second terminal being higher than a voltage on the first terminal, diode 110 might not conduct current. In some embodiments the diode may be a schottky diode.

As discussed above, bootstrapped power circuit 100 may further include bootstrap circuit 114 which may be configured to store an amount of energy or charge and release the stored charge to provide controller 102 with enough charge or energy to commence operation, as may be the case when the associated electronic device is turned on or starting to be used by a user. As previously discussed, controller 102 would not otherwise be able to commence operation because the amplitude of the voltage provided by power source 118 alone might not be sufficient to power operation of controller 102. Accordingly, bootstrap circuit 114 may include one or more charge storage devices that store an amount of charge that may be released when needed by controller 102 and during the subsequent operation of controller 102 and the associated electronic device.

In various embodiments, bootstrap circuit 114 may be coupled to other components of bootstrapped power circuit 100 via a switch, such as switch 116. In various embodiments, switch 116 may have a first position and a second position. When in a first position, switch 116 may couple a first terminal of bootstrap circuit 114 to a first terminal of power source 118 and a circuit ground. In some embodiments, the first terminal of power source 118 may be its negative terminal. Accordingly, when in this configuration, bootstrap circuit 114 and power source 118 may be coupled in parallel. When in a second position, switch 116 may couple the first terminal of bootstrap circuit 114 to a second terminal of power source 118, which may be its positive terminal. Accordingly, when in this configuration, bootstrap circuit 114 and power source 118 may be coupled in series. Moreover, when in the second position, switch 116 may further couple a second terminal of bootstrap circuit 114 to diode 110 and controller 102. Accordingly, when switch 116 is in the first position, bootstrap circuit 114 and power source 118 are coupled in parallel and bootstrap circuit 114 may be charged by power source 118 to store an amount of charge or voltage such that bootstrap circuit has a voltage potential equivalent to that of power source 118. For example, if power source 118 has a voltage of 1.8V, bootstrap circuit 114 may be charged to 1.8V. When switch 116 is in the second position, bootstrap circuit 114 and power source are coupled in series, thus boosting the overall voltage applied to controller 102 from 1.8V to 3.6V, and providing sufficient voltage to controller 102 to commence operation.

While one implementation of switch 116 and bootstrap circuit 114 is shown, other orientations and implementations are contemplated and disclosed herein. For example, while bootstrapped power circuit 100 shows a first terminal of bootstrap circuit 114 being coupled to a second terminal of power source 118 and bootstrap circuit 114 being on the positive side of power source 118 when switch 116 is in the second position, bootstrap circuit 114 may alternatively have a second terminal coupled to a first terminal of power source 118 and may be on the negative side of power source 118 when switch 116 is in the second position. In this way any suitable coupling between bootstrap circuit 114 and power source 118 may be implemented by switch 116.

In some embodiments, bootstrap circuit 114 may function as a charge pump. In particular embodiments, bootstrap circuit operates as a one shot charge pump that may be operated mechanically, as will be described in greater detail below with reference to switch 116. Accordingly, bootstrap circuit 114 may include one or more capacitors configured to store an amount of charge and discharge the stored charge over a period of time that is sufficient to enable the powering up of controller 102. In various embodiments, the one or more capacitors included in bootstrap circuit 114 may be configured to supply the stored charge to controller 102 over a period of time that is between about 1 millisecond and 3 milliseconds depending on the current consumed by controller 102 and the time required for controller 102 to begin operation. Accordingly, the capacitance of bootstrap circuit may be between about 10 microfarads and 100 microfarads. As disclosed herein, various configurations of capacitors may be included in bootstrap circuit 114. For example, bootstrap circuit 114 may include a single capacitor, or may include a bank or array of capacitors. In another embodiment, bootstrap circuit 114 may comprise a small rechargeable battery.

In various embodiments, switch 116 may be a mechanical switch. Accordingly, switch 116 may be a simple switch that may be mechanically operated to toggle or switch between the first position and the second position. In some embodiments, switch 116 may switch between positions in response to an input provided by a user. The input may be a mechanical input in which the user has physically moved the position of the switch. Accordingly, when a user changes the position of a switch to turn an electronic device on, switch 116 may be moved from a first position to a second position. In various embodiments, switch 116 may be a Double Pole Double Throw (DPDT) switch.

As discussed above, bootstrapped power circuit 100 may further include power source 118. In some embodiments, the electronic device associated with bootstrapped power circuit 100 may be a battery powered device. Accordingly, power source 118 may be a battery having a standard size and voltage. For example, power source 118 may be a size AA alkaline battery having an initial voltage of about 1.65V, or may be a size AAA alkaline battery having an initial voltage of about 1.65V. As previously discussed, such voltages may ultimately decay over time as the batteries are used. For example, these voltages may decay to about 0.9V near the end of the life of the battery. In various embodiments, the electronic device associated with bootstrapped power circuit 100 may be a single cell device. Accordingly, power source 118 may include a single AA cell or a single AAA cell.

Figure 2:
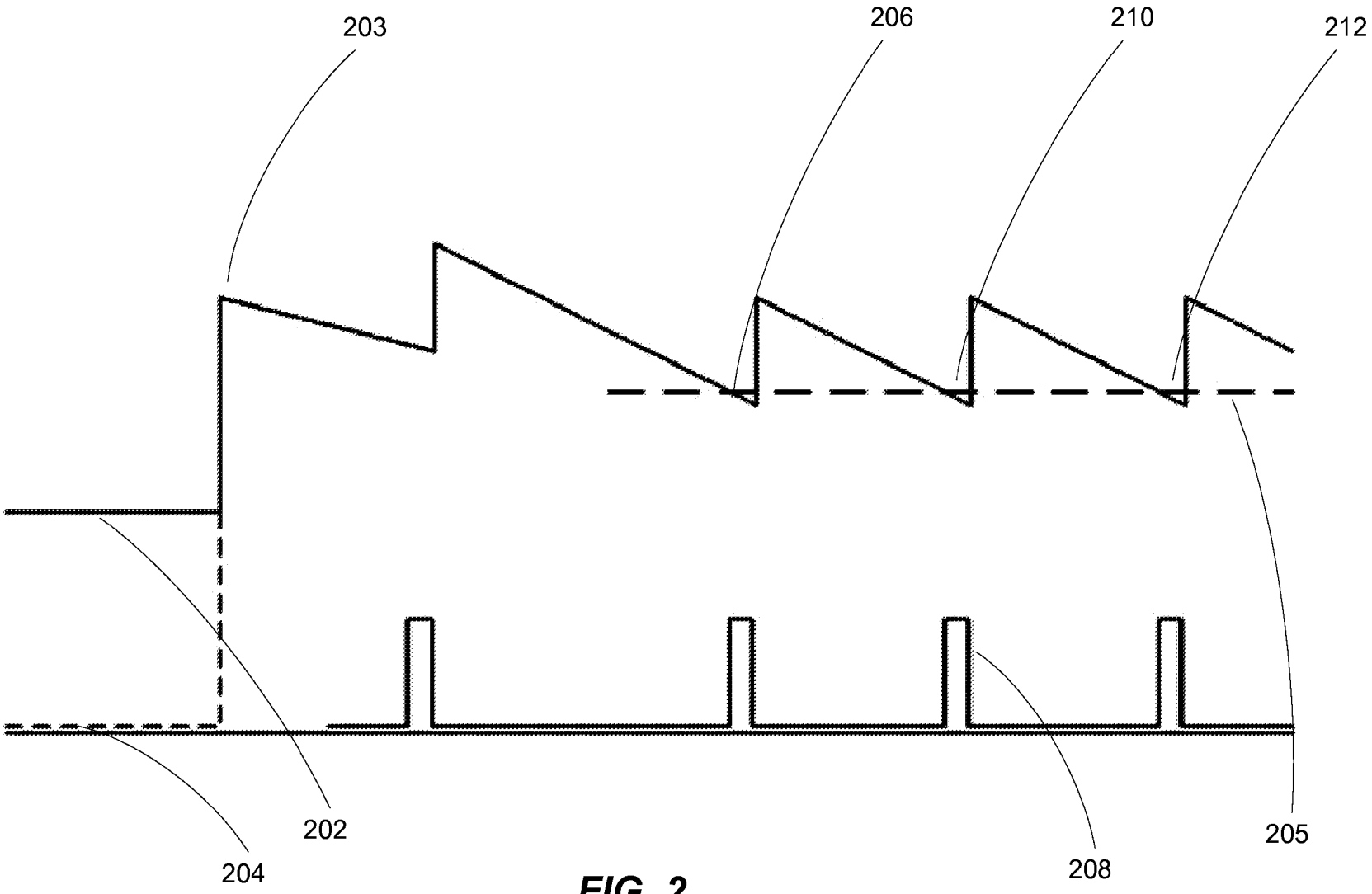
FIG. 2 illustrates a diagram of an example of voltage waveforms associated with a bootstrapped power circuit, implemented in accordance with some embodiments.

FIG. 2 illustrates a diagram of an example of voltage waveforms associated with a bootstrapped power circuit, implemented in accordance with some embodiments. As the voltage waveforms illustrate, a bootstrap circuit may initially be charged to a particular voltage potential which may be the same as a power source included in a consumer electronic device. When a switch changes position, the bootstrap circuit and the power source may be coupled in series and may be used to commence operation of a controller and/or store an amount of energy in an energy storage device, such as an inductor, of a power converter. Subsequently, as the energy stored in the bootstrap circuit decays, the controller may operate a transistor to periodically recharge the bootstrap circuit using the energy storage device to augment or supplement the operational voltage of the power source and ensure that a sufficient operational voltage is maintained at Vdd terminal 120 of controller 102.

In various embodiments, voltage waveform 202 represents a voltage or potential across a bootstrap circuit, such as bootstrap circuit 114 discussed above with reference to FIG. 1. In some embodiments, voltage waveform 202 may be a voltage at a second terminal of the bootstrap circuit, which may function as part of a charge pump that includes a capacitor. As discussed above, the second terminal may be coupled to an input pin, such as a VDD pin or terminal, of the controller. As shown by voltage waveform 202, the voltage may initially be charged to an amplitude that matches that of a power source. As similarly discussed above, a switch, such as switch 116, may be in a first position in which the bootstrap circuit is coupled in parallel with the power source. At time 203, the switch may be moved to the second position, and bootstrap circuit may be coupled in series with the power source. Accordingly, the voltage at the second terminal of the bootstrap circuit may approximately double in amplitude. As time progresses, the charge stored in the bootstrap circuit may decay, and the voltage may decay. During this initial period of time, the voltage applied to a controller, such as controller 102 discussed above, shown by voltage waveform 204 may be brought high enough and for a sufficient duration of time to enable controller 102 to power up and commence operation.

In various embodiments, the controller may be configured to have a low voltage detect or interrupt signal which warns the controller when a supply voltage is getting low and generates a signal in response to the supply voltage crossing a particular threshold. For example, a controller may be configured to have an associated threshold voltage, such as threshold voltage 205. When the voltage at the second terminal of the bootstrap circuit and the controller falls below the threshold, such as at time 206, controller may generate a signal which may be provided to a transistor, such as transistor 108. In various embodiments, the crossing of the threshold may be determined based on the low voltage signal previously described, or based on an output generated by an on-chip comparator.

Accordingly, voltage waveform 208 may represent a voltage applied to a control terminal of a transistor, which may be a base or a gate terminal. The signal generated by the controller may be a pulse which applies a voltage to the transistor and switches the transistor from one state to another. Accordingly, when a high voltage is newly applied to the control terminal of the transistor, the transistor may be switched on, causing current to flow through the energy storage device, such as an inductor included in a power converter. Subsequently, when a low voltage is applied to the control terminal of the transistor, current ceases to flow through the energy storage device, and in response the voltage on the terminal of the energy storage device which is coupled to the diode rises rapidly, causing current to flow through the diode charging a component of the bootstrap circuit. This may occur periodically at additional times 210 and 212. In some embodiments, the time between the voltage pulses of voltage waveform 208 applied to the control terminal of the transistor may be approximately constant, or may vary depending on the current drawn by the controller 102, the voltage provided by power source 118 and/or other factors. In this way, an output voltage generated by the bootstrapped power circuit may be kept within the operational range for the electronic device.

Figure 3:
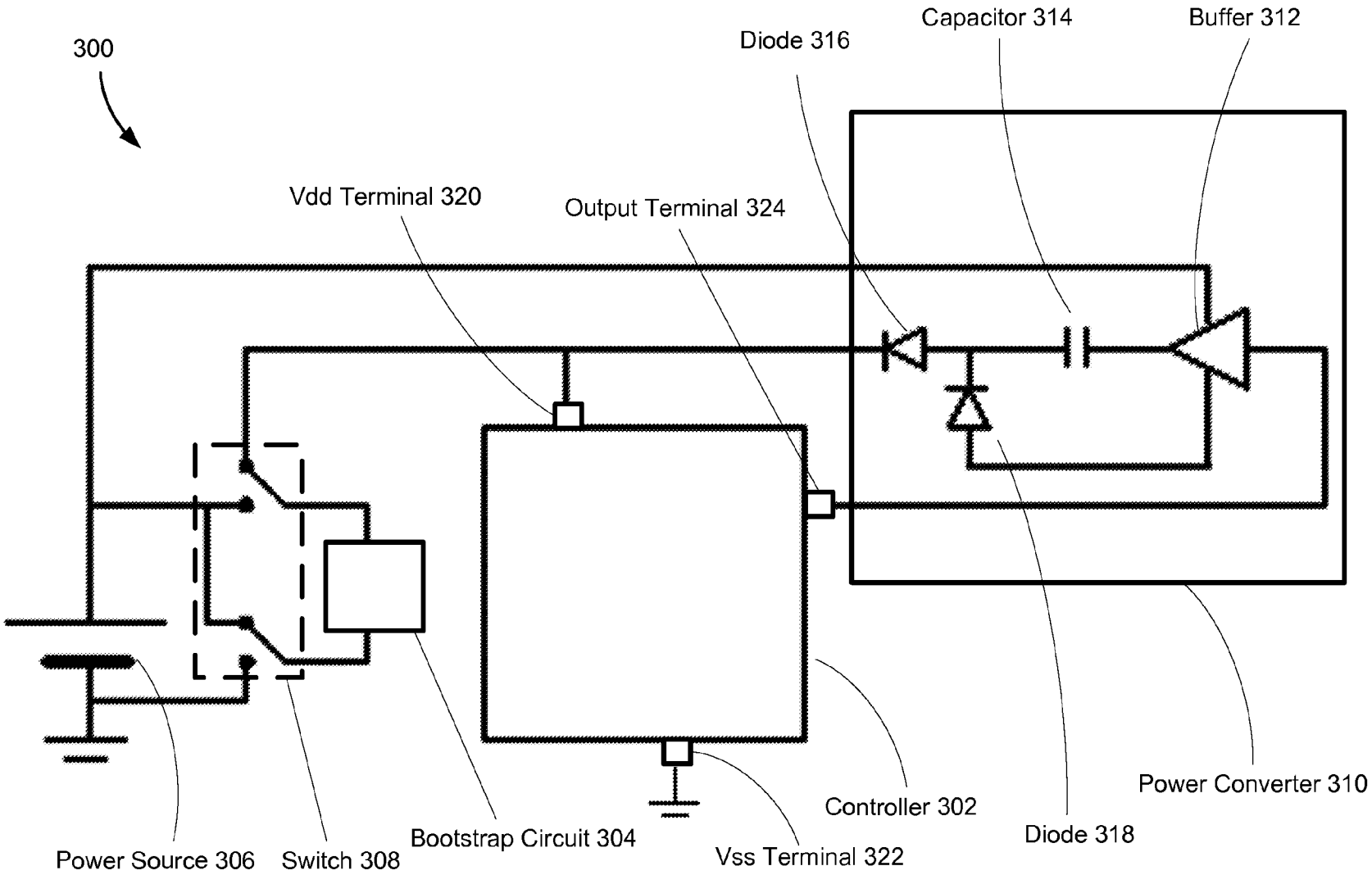
FIG. 3 illustrates a diagram of another example of a bootstrapped power circuit, implemented in accordance with some embodiments.

FIG. 3 illustrates a diagram of another example of a bootstrapped power circuit, implemented in accordance with some embodiments. As similarly discussed above with reference to FIG. 1, bootstrapped power circuit 300 may include controller 302, bootstrap circuit 304, power source 306, and switch 308 which may be configured to couple bootstrap circuit with power source 306 and controller 302. As similarly discussed above, when switch 308 is in a first position, bootstrap circuit 304 may be coupled in parallel with power source 306. When switch 308 is in a second position, bootstrap circuit 304 may be coupled in series with power source 306. Accordingly, bootstrap circuit 304 may be charged and discharged to provide an initial amount of charge or energy sufficient to commence operation of controller 302, and to maintain an output voltage generated by bootstrapped power circuit 300.

In some embodiments, controller 302 may be configured to have an output pin, terminal, or port, such as output terminal 324, which may be configured to generate an output signal having a relatively high current. Thus, an output generated by controller 302 may be configured to drive current sufficient to drive a power converter, such as power converter 310, and bootstrapped power circuit 300 may be implemented without an inductor or a transistor such as inductor 106 and transistor 108 discussed above with reference to FIG. 1. Accordingly, power converter 310 may be configured to include buffer 312, capacitor 314, diode 316, and diode 318. Alternatively, buffer 312 may be omitted. As shown in FIG. 3, in response to the voltage at Vdd terminal 320 of controller 302 falling below a threshold voltage, controller 302 may generate an output signal and provide the output signal to buffer 312 which may cause a current to pass through diode 316, charge bootstrap circuit 304 and raise the voltage at the terminal of controller 302. In some embodiments, the output signal may comprise a square wave oscillating between the Vdd and Vss voltages at Vdd terminal 320 and Vss terminal 322. When the voltage at Vdd terminal 320 of controller 302 is sufficiently high and above a threshold value, the output signal might not be sent, and the voltage at Vdd terminal 320 of controller 302 may be held at a voltage equal to the combination of the potential stored by bootstrap circuit 304 and power source 306.

Figure 4:
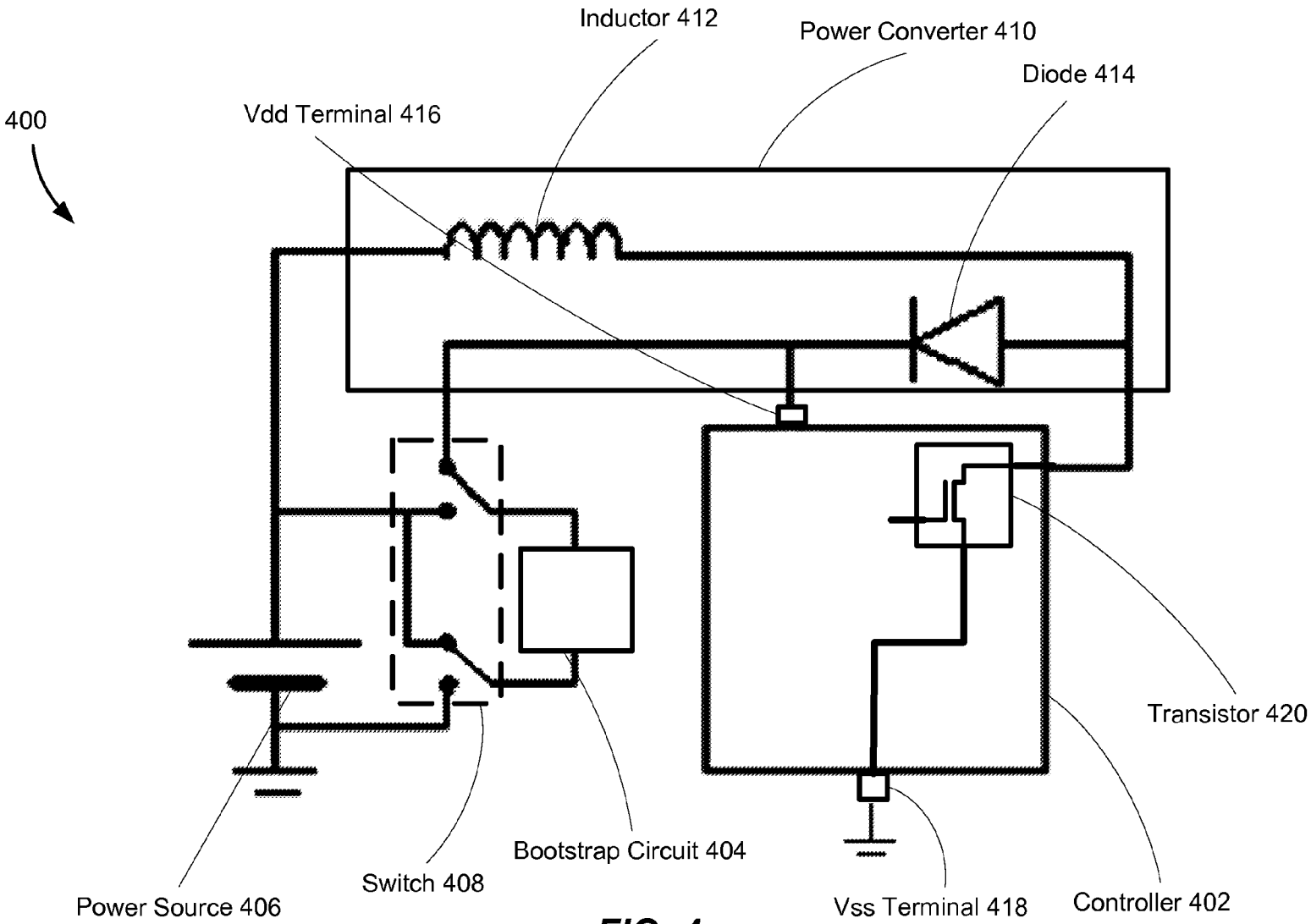
FIG. 4 illustrates a diagram of yet another example of a bootstrapped power circuit, implemented in accordance with some embodiments.

FIG. 4 illustrates a diagram of yet another example of a bootstrapped power circuit, implemented in accordance with some embodiments. As similarly discussed above with reference to FIG. 1 and FIG. 3, bootstrapped power circuit 400 may include controller 402, which may include Vdd terminal 416 and Vss terminal 418. Bootstrapped power circuit 400 may further include bootstrap circuit 404, power source 406, and switch 408 which may be configured to couple bootstrap circuit with power source 406 and controller 402. As similarly discussed above, when switch 408 is in a first position, bootstrap circuit 404 may be coupled in parallel with power source 406. When switch 408 is in a second position, bootstrap circuit 404 may be coupled in series with power source 406. As discussed above, bootstrap circuit 404 may be charged and discharged to provide an initial amount of charge or energy sufficient to commence operation of controller 402. As shown in FIG. 4, power converter 410 may include energy storage device 412, which may be an inductor, and diode 414, which may operate similarly to inductor 106 and diode 110 discussed above with reference to FIG. 1. However, controller 402 may be configured to include a switching transistor, such as transistor 420, which may be configured to function as described above with reference to transistor 108. Accordingly, transistor 420 may be implemented as an internal component of controller 402 and may be operated by controller 402 to control the charge and discharge of energy storage device 412 and bootstrap circuit 404.

Figure 5:
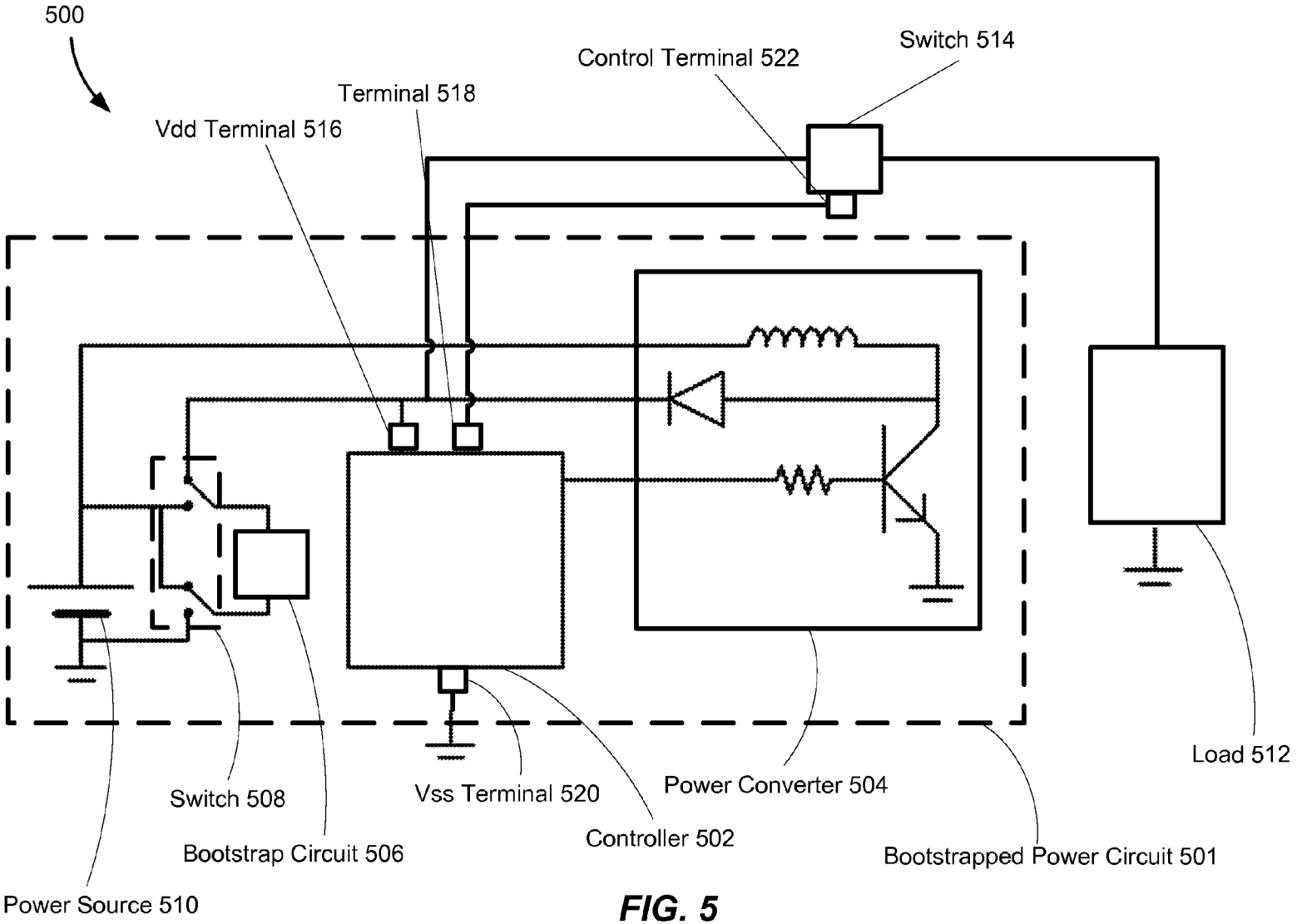
FIG. 5 illustrates a diagram of an example of a bootstrapped power circuit coupled to a load circuit, implemented in accordance with some embodiments.

FIG. 5 illustrates a diagram of an example of a bootstrapped power circuit coupled to a load circuit, implemented in accordance with some embodiments. As similarly discussed above, bootstrapped power circuit 501 may be included in an electronic device, such as electronic device 500. Bootstrapped power circuit 501 may include various components configured to generate an output signal that may provide a supply voltage for other components of electronic device 500, thus enabling the operation of electronic device 500. Accordingly, Bootstrapped power circuit 501 may include controller 502, which may include Vdd terminal 516, terminal 518, and Vss terminal 520. Bootstrapped power circuit 501 may also include power converter 504, bootstrap circuit 506, switch 508, and power supply 510.

In various embodiments, electronic device 500 may be one of various low power consumer electronic devices. For example, electronic device 500 may be an electronic toothbrush, an electronic shaver, a wireless mouse, a wireless keyboard, or a remote control. In various embodiments, one or more components of electronic device 500 may be coupled to bootstrapped power circuit 501 as a load to which a voltage is applied. As shown in FIG. 5, a load, such as load 512, may have a first terminal coupled to a terminal of controller 502, which may be Vdd terminal 516. Load 512 may also have a second terminal coupled to a circuit ground. Accordingly, load 512 may be powered by a voltage potential equivalent to the Vdd voltage. As discussed above, the load may include one or more components of electronic device 500 such as a motor, a speaker, a wireless radio, or a light emitting diode (LED) or other optical transmitter.

Furthermore, electronic device 500 may further include another switch, such as switch 514, which may be configured to be toggled between a third position and a fourth position. In some embodiments, load 512 may be coupled to controller 502 via switch 514. When in the third position, switch 514 may be configured to uncouple bootstrapped power circuit 501 from load 512. In various embodiments, switch 514 may be controlled by controller 502 via a control terminal, such as control terminal 522, which may be coupled to a terminal, such as terminal 518, of controller 502. When in the fourth position, switch 514 may be configured to couple bootstrapped power circuit 501 with load 512 under the control of terminal 518 of controller 502, thus providing load 512 with power. Thus, switch 514 may be an electronic switch controlled by terminal 518 of controller 502.

Figure 6:
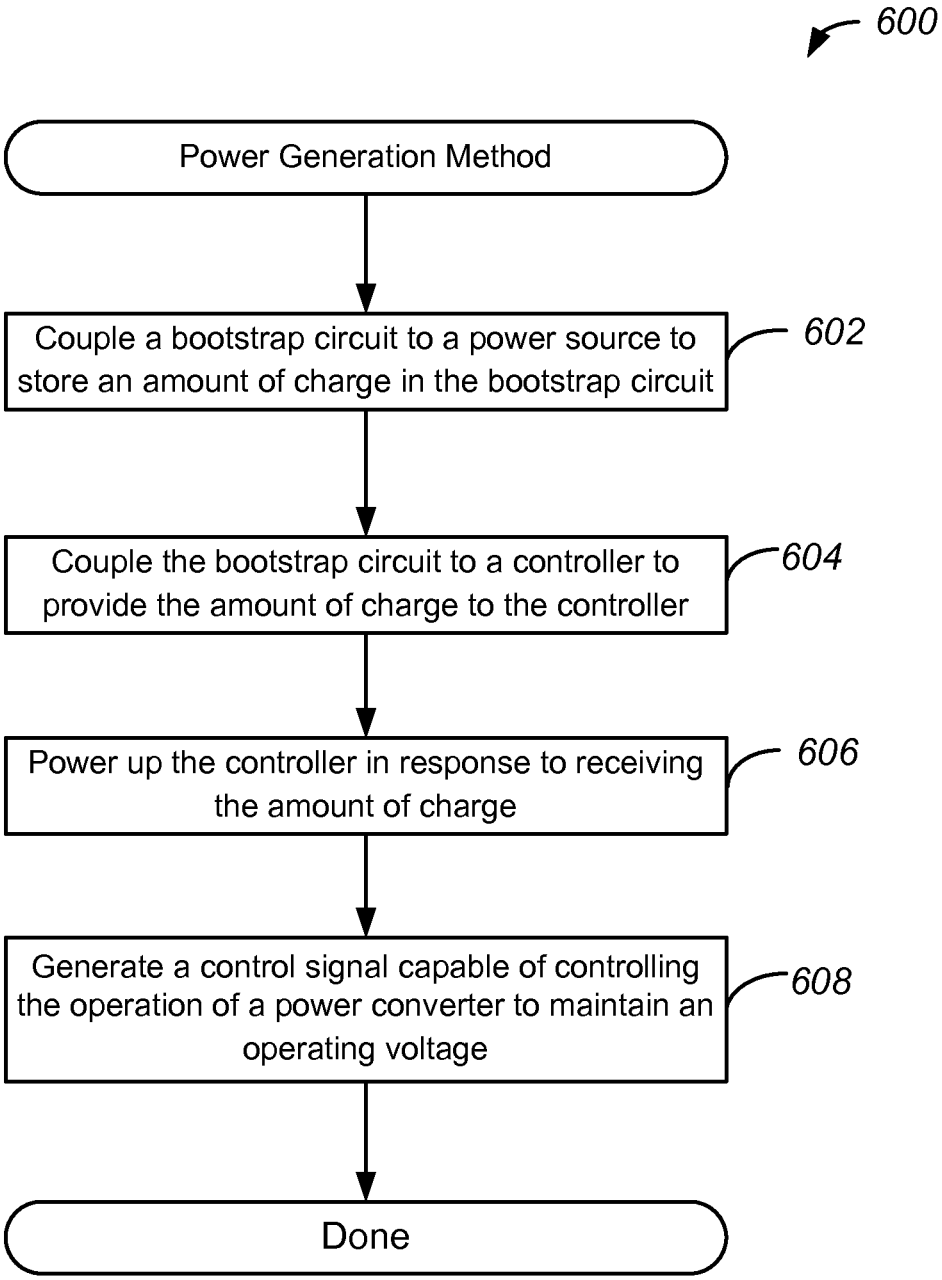
FIG. 6 illustrates a flow chart of an example of a power generation method implemented in accordance with some embodiments.

FIG. 6 illustrates a flow chart of an example of a power generation method implemented in accordance with some embodiments. As similarly discussed above, a bootstrapped power circuit may be used to generate a power supply signal for one or more components of an electronic device. A bootstrap circuit may be implemented to provide an initial amount of voltage or charge to a controller to commence operation of the controller. Once the controller is powered up and operational, the controller may manage the operation of a power converter and ensure that the power supply signal is maintained within a particular operating voltage range.

Accordingly, method 600 may commence at operation 602 during which a bootstrap circuit may be coupled to a power source to store an amount of charge in the bootstrap circuit. Accordingly, a bootstrap circuit may be coupled to the power source in parallel such that a potential across the bootstrap circuit matches that of the power source. As similarly discussed above, the bootstrap circuit may be coupled to the power source via a switch which may be a mechanical switch that is in a first position.

Method 600 may proceed to operation 604 during which the bootstrap circuit may be coupled to a controller to provide at least a portion of the amount of charge to the controller. In some embodiments, the switch may be moved to a second position to couple the bootstrap circuit in series with the power source where one terminal of the bootstrap circuit is also coupled to a terminal, such as the Vdd terminal, of the controller. Accordingly, the combined voltage of the bootstrap circuit and the power source may be applied to the Vdd terminal of the controller.

Method 600 may proceed to operation 606 during which the controller may be powered up in response to receiving the amount of charge. As discussed above, the controller may utilize a particular amount of voltage to turn on or power up and commence operation. In some embodiments, the amount of voltage utilized may be 2V or above, which may be greater than the voltage provided by the power source alone, which may be 1.5V. However, when the voltage of the power source is combined with the voltage provided by the bootstrap circuit, the combined voltage may be in excess of 2V and may be sufficient to enable the controller to power up and commence operation. As similarly discussed above, the powering up of the controller may occur within a duration of time of about 1 millisecond to 3 milliseconds.

Figure 7:
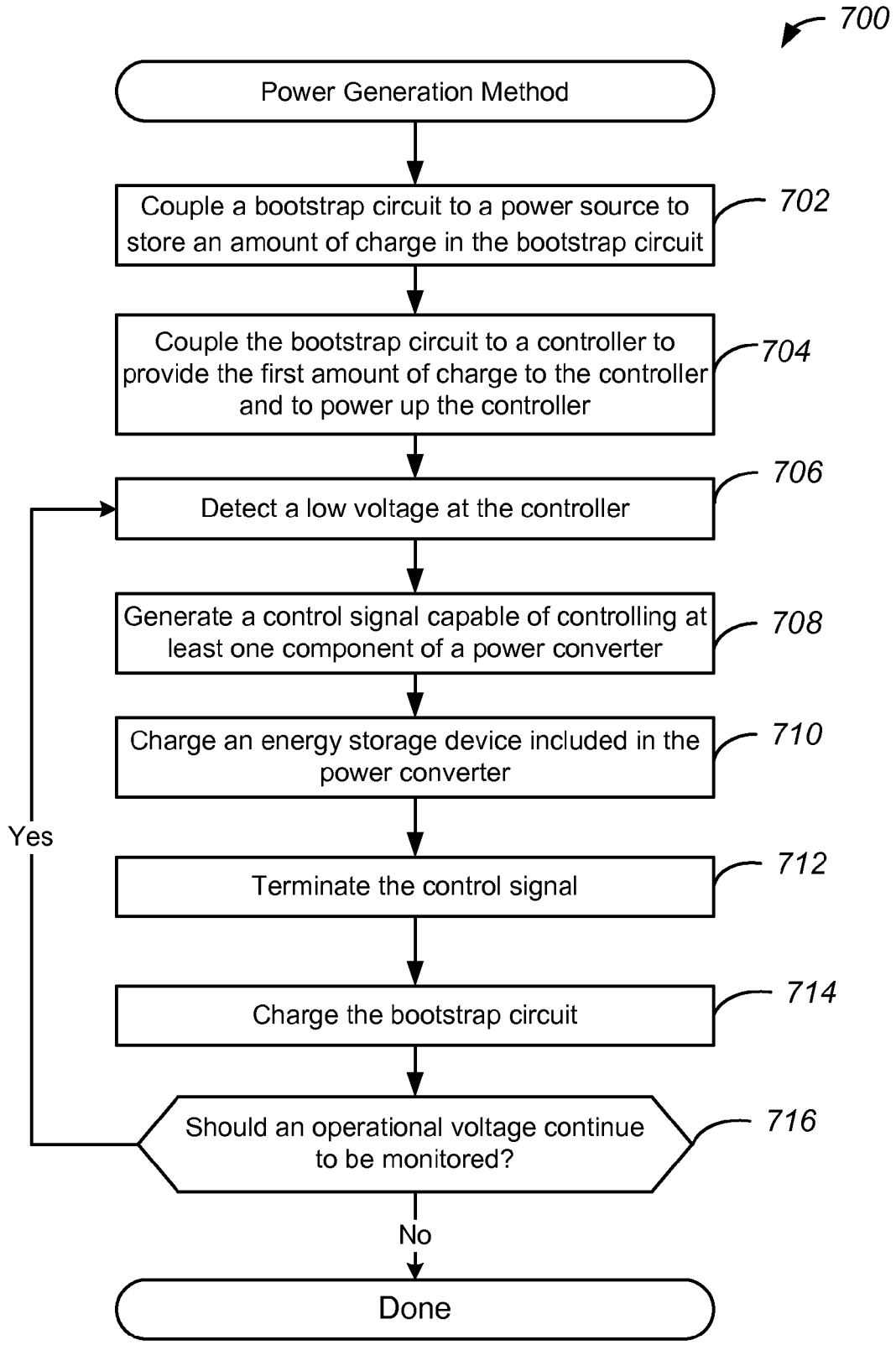
FIG. 7 illustrates a flow chart of another example of a power generation method implemented in accordance with some embodiments.

Method 600 may proceed to operation 608 during which a control signal may be generated that is capable of controlling the operation of a power converter to maintain an operating voltage. As similarly discussed above, the controller may generate an output or a control signal which controls the operation of one or more components of the power converter. As will be discussed in greater detail below with reference to FIG. 7, once the controller has powered up and is operational, the controller may manage the operation of the power converter to maintain a sufficiently high operational voltage for as long as the electronic device remains on and the power source has sufficient voltage remaining FIG. 7 illustrates a flow chart of another example of a power generation method implemented in accordance with some embodiments. As similarly discussed above, a bootstrap circuit may be implemented to power up a controller. Once the controller is powered up and operational, the controller may periodically or dynamically measure an operational voltage, which may refer to a power supply voltage provided to the controller as well as a load coupled to the bootstrapped power circuit that includes the controller. The controller may generate a control signal that controls the operation of various components of the power converter to ensure that the operational voltage stays within operational tolerances or above a particular threshold value.

Method 700 may commence with operation 702 during which a bootstrap circuit may be coupled to a power source to store an amount of charge in the bootstrap circuit. As similarly discussed above, the bootstrap circuit may be coupled to the power source in parallel and may be charged to store an equal potential. Subsequently, during operation 704, the bootstrap circuit may be coupled to a controller to provide a first amount of charge to the controller and to power up the controller. As similarly discussed above, a switch may be manipulated to couple the bootstrap circuit to the controller and to provide the charge to the controller thus enabling the controller to power up and commence operation.

Method 700 may proceed to operation 706 during which the controller may detect a low voltage. In various embodiments, the controller may be configured to periodically or dynamically check a voltage at a particular input pin or port of the controller. For example, the controller may check a voltage applied to its power supply pin which may be the Vdd pin or terminal. The controller may check the measured voltage against a reference or threshold voltage. If the measured voltage falls below the threshold voltage, the controller may identify or detect a low voltage. In various embodiments, the threshold voltage may be configured or determined to be a designated amount above a minimum operating voltage of the controller. For example, if a controller has a minimum operating voltage of 1.8V, a threshold voltage of 2V may be used.

Method 700 may proceed to operation 708 during which a control signal may be generated. As similarly discussed above, the control signal may be capable of controlling the operation of at least one component of a power converter. For example, the control signal may be provided to a terminal of a transistor included in the power converter. Thus, the generation of the control signal may toggle or switch a state of the transistor thus affecting the flow of current through the transistor and other components of the power converter. In this example, the control signal may be a voltage pulse applied to the base terminal of the transistor. The voltage pulse may switch the transistor an "on" state such that conductivity is increased between the emitter and collector of the transistor, and is similar to a short circuit. While this example has been discussed with reference to a BJT transistor, a FET transistor may be similarly used.

Method 700 may proceed to operation 710 during which an energy storage device included in the power converter may be charged. As discussed above, the energy storage device may be an inductor. Accordingly, when the transistor is switch on, a terminal of the inductor coupled to the transistor may effectively be grounded. The other terminal of the inductor may be coupled to the power source. When biased in this way, current may flow through the inductor, and the inductor may be store energy received from the power source by virtue of the inductor's magnetic properties.

Method 700 may proceed to operation 712 during which the control signal may be terminated. In various embodiments, the control signal may be terminated after a designated period of time. Thus, the control signal applied to the transistor may have a designated or predetermined pulse width, and after a particular duration of time, the pulse may terminate. Once the pulse has terminated, the voltage applied to the transistor may terminate and the transistor may be switched to an "off" position or state such that the conductivity between the other two terminals of the transistor is decreased and is similar to an open circuit.

Method 700 may proceed to operation 714 during which the bootstrap circuit may be charged. In various embodiments, when the transistor has been turned off, the inductor may discharge the energy that was previously stored during operation 710. The voltage at the terminal of the inductor that is coupled to the transistor may be high enough to ensure conductivity of a diode coupled between the inductor and the bootstrap circuit. Thus, when the inductor is energized and the transistor has been switched off, the diode may form a conductive path through which a voltage may be applied to a terminal of the bootstrap circuit and the bootstrap circuit may be recharged. As previously discussed, the bootstrap circuit may include a capacitor. Accordingly, the voltage received from the inductor may charge the capacitor, and the overall voltage potential at the pin or port of the controller may be raised or increased. In this way, voltage decay that may occur due to discharging of the capacitor or other charge storage component included in the bootstrap circuit may be counteracted by periodic recharging from the power converter as controlled by the controller, once operational.

Method 700 may proceed to operation 716 during which it may be determined if the operational voltage should continue to be monitored. In various embodiments, the monitoring of the voltage at the pin or port of the controller, which may be a Vdd pin or terminal, may continue as long as the electronic device is operational. Accordingly, the monitoring may continue as long as the switch is in the second position and as long as the controller has sufficient power to operate. If it is determined that the voltage should continue to be monitored, method 700 may return to operation 706 where it may be determined if another low voltage has been detected. If it is determined that the voltage should not continue to be monitored, method 700 may terminate.

Although the foregoing concepts have been described in some detail for purposes of clarity of understanding, it will be apparent that certain changes and modifications may be practiced within the scope of the appended claims. It should be noted that there are many alternative ways of implementing the processes, systems, and devices. Accordingly, the present examples are to be considered as illustrative and not restrictive.

What is claimed is:

1. A device comprising:

a controller configured to generate an output signal based on a detected input voltage, the controller further configured to begin operation in response to receiving a first voltage having a first amplitude;

a power converter coupled to the controller and configured to receive the output signal, the power converter further configured to store an amount of energy in response to receiving the output signal, and the power converter further configured to release at least part of the amount of energy in response to detecting a change in the output signal;

a switch configured to be set to one of a plurality of positions, the plurality of positions comprising a first position and a second position;

a power source coupled to the power converter and the switch power source configured to supply a second voltage having a second amplitude; and a bootstrap circuit configured to be coupled in parallel with the power source, receive the second voltage from the power source, and store a third voltage based on the received second voltage when the switch is in the first position and when the controller is in an unpowered state, the bootstrap circuit further configured to be coupled in series with the power source and coupled to an input terminal of the controller when the switch is in the second position, the switching to the second position being associated with powering up the controller, wherein a combined amplitude of the second voltage and the third voltage is greater than the first amplitude, and the bootstrap circuit further configured to receive at least some of the amount of energy from the power converter when the switch is in the second position.

2. The device of claim 1, wherein the bootstrap circuit includes at least one capacitor having a capacitance configured to store the third voltage.

3. The device of claim 1, wherein a combination of the second voltage and the third voltage is sufficient to enable the operation of the controller.

4. The device of claim 1, wherein the switch is a mechanical switch.

5. The device of claim 4, wherein the switch is configured to change between the first position and the second position in response to actuation by a user.

6. The device of claim 1, wherein the power converter is an inductor-based power converter.

7. The device of claim 1, wherein the power converter includes a transistor, and wherein the output signal is received at the transistor.

8. The device of claim 7, wherein the output signal is a pulse, and wherein the change detected by the power converter is a termination of the pulse.

9. The device of claim 1, wherein the controller is a microcontroller unit (MCU), the MCU comprising a processor core and a memory.

10. The device of claim 9, wherein the controller is configured to generate a power supply signal for at least one electrical component of a battery-powered electrical device.

11. A system comprising:

a bootstrapped power circuit comprising:

a controller configured to generate an output signal based on a detected input voltage, the controller further configured to begin operation in response to receiving a first voltage having a first amplitude;

a power converter coupled to the controller and configured to receive the output signal, the power converter further configured to store an amount of energy in response to receiving the output signal, and the power converter further configured to release at least part of the amount of energy in response to detecting a change in the output signal;

a first switch configured to be set to one of a first plurality of positions, the first plurality of positions comprising a first position and a second position;

a power source coupled to the power converter and the first switch, the power source configured to supply a second voltage having a second amplitude; and a bootstrap circuit configured to be coupled in parallel with the power source, receive the second voltage from the power source, and store a third voltage based on the received second voltage when the first switch is in the first position and when the controller is in an unpowered state, the bootstrap circuit further configured to be coupled in series with the power source and coupled to an input terminal of the controller when the switch is in the second position, the switching to the second position being associated with powering up the controller, wherein a combined amplitude of the second voltage and the third voltage is greater than the first amplitude, and the bootstrap circuit further configured to receive at least some of the amount of energy from the power converter when the first switch is in the second position; and aloud circuit coupled to the bootstrapped power circuit and configured to receive a voltage supply signal from the controller.

12. The system of claim 11, wherein the bootstrap circuit includes a capacitor having a capacitance configured to store the third voltage, and wherein the first switch is a mechanical switch.

13. The system of claim 11, wherein a combination of the second voltage and the third voltage is sufficient to enable the operation of the controller.

14. The system of claim 11 further comprising a second switch configured to be set to one of a second plurality of positions, the second plurality of positions comprising a third position and a fourth position, the second switch configured to uncouple the bootstrapped power circuit from the load circuit when in the third position, and the second switch configured to couple the bootstrapped power circuit with the load circuit when in the fourth position.

15. The system of claim 11, wherein the load circuit comprises a motor configured to generate mechanical motion in response to receiving the voltage supply signal.

16. The system of claim 11, wherein the load circuit comprises a light emitting diode (LED).

17. A method comprising:

coupling, by switching a switch to a first position, a bootstrap circuit to a power source in parallel to store a first voltage having a first amplitude in the bootstrap circuit, the power source storing a second voltage having a second amplitude, the bootstrap circuit receiving the second voltage and storing the first voltage when the switch is in the first position;

coupling, by switching the switch to a second position, the bootstrap circuit to an input terminal of a controller in an unpowered state, and in series with the power source to provide the first voltage and the second voltage to the input terminal of the controller;

powering up the controller in response to receiving the first voltage and the second voltage, an amplitude of a combination of the first voltage and the second voltage being greater than an amplitude of an operational voltage associated with the controller;

generating, using the controller, an output signal in response to identifying a low voltage at the input terminal of the controller, the controller beginning operation in response to receiving the combination of the first voltage and the second voltage;

providing the output signal to a power converter;

storing, in the power converter, an amount of energy in response to receiving the output signal; and releasing at least part of the amount of energy to the bootstrap circuit in response to detecting a change in the output signal and when the switch is in the second position.

18. The method of claim 17, wherein the releasing of the at least part of the amount of energy further comprises:

detecting, by the power converter, a termination of the output signal; and providing at least part of the amount of energy to the bootstrap circuit in response to detecting the termination of the output signal.

* * * * *